US005384225A

United States Patent [19]

Kurotori et al.

[11] Patent Number: 5,384,225

[45] Date of Patent: Jan. 24, 1995

[54] LIQUID DEVELOPER FOR LATENT ELECTROSTATIC IMAGES

[75] Inventors: Tsuneo Kurotori, Tokyo; Manabu Mochizuki; Kenzo Ariyama, both of Yokohama; Kenji Kojima, Tokyo; Ichiro Tsuruoka, Nihonbashi; Katsuhiro Echigo, Yokohama; Mayumi Miyao, Tokyo, all of Japan

[73] Assignee: Ricoh Company, Ltd., Tokyo, Japan

[21] Appl. No.: 984,274

[22] Filed: Dec. 1, 1992

Related U.S. Application Data

[63] Continuation of Ser. No. 544,210, Jun. 26, 1990, abandoned.

[30] Foreign Application Priority Data

Jun. 30, 1989 [JP] Japan ..... 1-166826
Jul. 3, 1989 [JP] Japan ..... 1-169831

[51] Int. Cl.[6] ..... G03G 9/00

[52] U.S. Cl. ..... 430/116; 430/112; 355/256

[58] Field of Search ..... 430/116, 115, 112; 355/256

[56] References Cited

U.S. PATENT DOCUMENTS

| | | | |
|---|---|---|---|
| 3,850,829 | 11/1974 | Smith et al. | 430/113 |
| 3,856,692 | 12/1974 | Mannino et al. | 430/116 |
| 3,878,120 | 4/1975 | Nagashima | 430/116 |
| 3,918,969 | 11/1975 | Goffe | 430/41 |
| 4,052,325 | 10/1977 | Santilli | 430/114 |

FOREIGN PATENT DOCUMENTS 3068963 3/1991 Japan .

*Primary Examiner*—Steven Rosasco
*Attorney, Agent, or Firm*—Cooper & Dunham

[57] ABSTRACT

A liquid developer for developing latent electrostatic images comprises (i) a carrier liquid comprising at least one component selected from the group consisting of a phenylmethyl silicone oil and a cyclic dimethyl polysiloxane, and (ii) toner particles dispersed in said carrier liquid, and images are formed by a wet-type electrophotographic image formation method using the liquid developer and thermally fixed to a transfer sheet.

8 Claims, 2 Drawing Sheets

LIQUID DEVELOPER FOR LATENT ELECTROSTATIC IMAGES

This is a continuation of application Ser. No. 544,210, filed Jun. 26, 1990, now abandoned.

BACKGROUND OF THE INVENTION

1. Field of the Invention

The present invention relates to a liquid developer for developing latent electrostatic images, and more particularly to a liquid developer composed of (i) a carrier liquid comprising at least a phenylmethyl silicone or a cyclic dimethyl polysiloxane, and (ii) toner particles dispersed :in the carrier liquid.

2. Discussion of Background

A liquid developer for developing latent electrostatic images is generally prepared by dispersing a toner comprising a coloring agent and a resin in a carrier liquid which has high insulating properties and a low dielectric constant, together with a polarity controlling agent when necessary.

Conventionally, cyclohexane, decalin, kerosine, aliphatic hydrocarbon liquids, gas oil, gasoline and fluorinated hydrocarbons are available as the carrier liquids of the liquid developer.

Generally the carrier liquid for the liquid developer must have the following properties: (1) a high electrical resistivity of $10^{14}$ Ωcm or more; (2) a low dielectric constant of 3 or less; (3) a low, solubility with a solubility coefficient of about 7; (4) no odor; transparent; (6) not irritating to the skin; (7) nontoxic; (8) low flammability; and (9) quick-drying. With the aforementioned requirements for the carrier liquid taken into consideration, aliphatic hydrocarbon liquids, for example, commercially available "Isopar" (Trademark), made by Exxon. Chemical Japan Ltd., are used in practice.

Recently, there is a demand for a wet-type copying apparatus capable of yielding images with high image density even when many different kinds of transfer sheets are used. In order to obtain high image density, conventionally a large quantity of toner is caused to be deposited on a transfer sheet. However, when the amount of toner to be deposited on the transfer sheet is increased, it is necessary that the temperature of a heat-application roller in an image fixing unit be elevated to obtain better image fixing performance. Furthermore, it is necessary to employ a carrier liquid with high volatility for the liquid developer. However, when a liquid developer containing such a carrier liquid with high volatility is used for making a large volume of copies in a closed room, the vapor of the carrier liquid eventually builds up in the room and as the concentration of the vapor is increased, the vaporized carrier liquid gives out an offensive or unpleasant odor and becomes unsafe to the human body. From this point of view, utmost care must be taken to obtain good ventilation of the room when the copying apparatus is in operation. In addition, it will be necessary to control the number of copies to be made at one time or the operating speed of the copying apparatus.

SUMMARY OF THE INVENTION

Accordingly, a first object of the present invention is to provide a liquid developer for developing latent electrostatic images comprising a carrier liquid, free from the environmental pollution problems, which does not generate any offensive or unpleasant odor while in use.

A second object of the present invention is to provide a liquid developer which copes with a high-speed image fixing operation in a copying apparatus.

A third object of the present invention is to provide a wet-type electrophotographic image formation method by using the above liquid developer.

The above-mentioned first and second objects of the present invention can be achieved by a liquid developer which is composed of a carrier liquid comprising at least a phenylmethyl silicone oil or a cyclic dimethyl polysiloxane, and toner particles dispersed therein.

The third object of the present invention is achieved by a wet-type electrophotographic image formation method comprising the steps of developing latent electrostatic images formed on an electrophotographic photoconductor with the above-mentioned liquid developer comprising the carrier liquid and toner particles dispersed therein to form toner images, transferring the toner images to a transfer sheet and thermally fixing the transferred toner images onto the transfer sheet.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

According to the present invention, a liquid developer for developing latent electrostatic images to visible toner images is prepared by dispersing toner particles in a carrier liquid comprising at least a phenylmethyl silicone oil or a cyclic dimethyl polysiloxane. This carrier liquid can satisfy not only the previously-mentioned fundamental requirements, such as high insulating properties, a low dielectric constant and excellent dispersibility of toner particles therein, but also safety in work operation, that is, no generation of an unpleasant odor.

Prior to the detailed explanation of the liquid developer according to the present invention, the mechanism of a wet-type electrophotographic copying apparatus in which the liquid developer according to the present invention is used will now be described with reference to FIG. 1.

Figure 1:
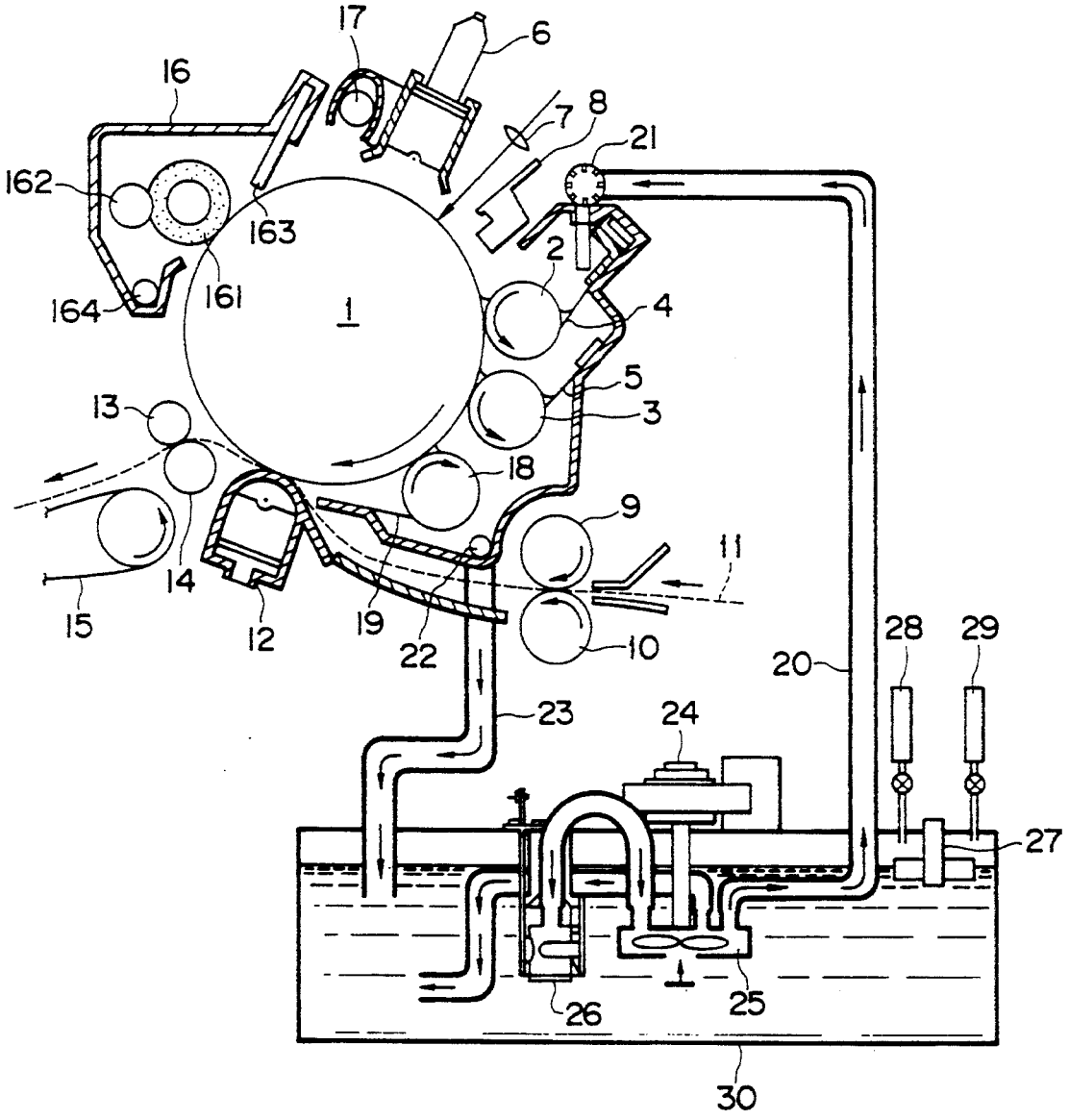
FIG. 1 is a schematic diagram of a wet-type electrophotographic copying apparatus in which a liquid developer according to the present invention is used.

In FIG. 1, a photoconductive drum 1 is driven in rotation in the direction of the arrow at a constant speed by a driving system (not shown) in the course of a copying operation. The outer surface of the photoconductive drum 1 is uniformly charged to a predetermined polarity by a main charger 6, and exposed to a light image which is converted from an original image by an optical system 7. Thus, a latent electrostatic image is formed on the surface of the photoconductive drum 1. Non-image-formation areas on the photoconductive drum 1 are quenched by an eraser 8.

The latent electrostatic image formed on the photoconductive drum i is developed to a visible toner image by means of development rollers 2 and 3 which support a liquid developer. The development rollers 2 and 3 are driven in rotation in the direction of the arrow, with a slight gap between the development rollers and the photoconductive drum 1. Residual toner particles are cleared off the development rollers 2 and 3 by scrapers 4 and 5.

The toner image thus developed on the photoconductive drum 1 is transferred by the aid of a transfer charger 12 to a sheet of paper 11 which is supplied from a paper supply unit (not shown) and carried by sheet-transportation rollers 9 and 10 along a paper path as indicated by the broken-line.

Figure 2:
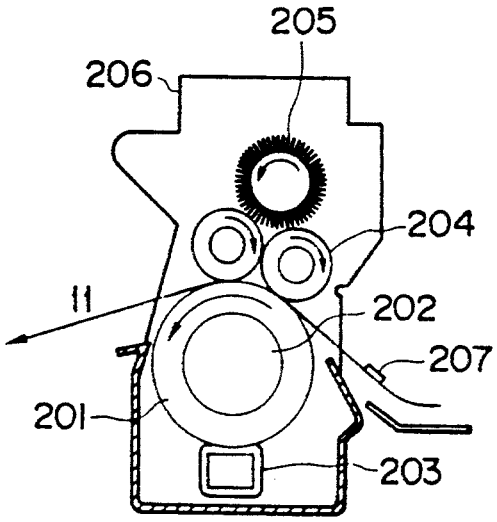
FIG. 2 is a schematic diagram of an image fixing unit in the electrophotographic copying apparatus shown in FIG. 1.

The transfer sheet 11 which bears the toner image is separated from the surface of the photoconductive drum 1 by separation rollers 13 and 14 and led to an image fixing unit as shown in FIG. 2 by the aid of a transfer-sheet conveyor belt 15.

In the image fixing unit as shown in FIG. 2, the transfer sheet 11 which bears a toner image 207 is caused to pass between a heat-application roller 201 having a built-in heater 202 and two pressure-application rollers 204.

In FIG. 2, reference numeral 203 indicates a cleaning pad; reference numeral 205, a cleaning brush; and reference numeral 206, an external cover.

After separation of the transfer sheet 11 from the photoconductive drum 1, the residual liquid developer on the photoconductive drum 1 is cleared therefrom in a cleaning unit 16 and the residual electric charge of the photoconductive drum 1 is then quenched by a quenching lamp 17 (or a quenching charger) to be ready for the subsequent copying operation.

In the above-mentioned cleaning unit 16, a cleaning foam roller 161, a squeeze roller 162 and a cleaning blade 163 are disposed as shown in FIG. 1. The residual liquid developer collected in the cleaning unit 16 is discharged outside through a residual-developer-recovery hole 164.

In the wet-type development unit, the development rollers 2 and 3, a squeeze roller 18, and a scraper 19 in contact with the squeeze roller 18 are disposed. One or a plurality of development rollers may be mounted in the development unit. It is preferable that the development rollers 2 and 3 be disposed, with a space of 0.1 to 0.2 mm from the photoconductive drum 1. It is desirable that the gap between the photoconductive drum 1 and the squeeze roller 18 be in the range of 0.05 to 0.09 mm. The development rollers 2 and 3 are driven in rotation by the driving system at a higher peripheral speed than that of the photoconductive drum 1, and furthermore, the squeeze roller 18 is driven in rotation at a still higher peripheral speed in the opposite direction to that of the photoconductive drum 1 at a contact area therebetween.

The liquid developer stored in a developer tank 30 is pumped out by a pump 25 which is operated by a pump motor 24, carried through a liquid developer supply pipe 20 and supplied to the development unit via a liquid developer supply nozzle 21. The unused liquid developer in the development unit is circulated in such a fashion that the unused liquid developer flows into a liquid-developer-collection hole 22 and returns to the developer tank 30 through a liquid-developer-collection pipe 23.

In FIG. 1, reference numeral 26 indicates a liquid-developer-concentration detector; reference numeral 27 indicates a float switch capable of detecting a liquid level; reference numeral 58 indicates a liquid developer spare tank; and reference numeral 29 indicates a carrier liquid spare tank.

The liquid developer according to the present invention is used in an electrophotographic copying apparatus as shown in FIG. 1.

As previously mentioned, the liquid developer according to the present invention comprises a carrier liquid and toner particles dispersed therein, which comprise a coloring agent and a resin.

The carrier liquid for use in the present invention comprises at least a phenylmethyl silicone oil or a cyclic dimethyl polysiloxane. It is preferable that the amount of the above-mentioned phenylmethyl silicone oil or cyclic dimethyl polysiloxane be 5 vol % or more, and more preferably 50 vol % or more, of the total amount of the carrier liquid.

The phenylmethyl silicone oil for use in the present invention is obtained by substituting a phenyl group for at least one methyl group of dimethyl polysiloxane oil.

As the commercially available phenylmethyl silicone oil for use in the present invention, "SH200", "SRX310", "PRX404" and "PRX407", made by Toray Silicone Co., Ltd.; and "KF56" and "KF58", made by Shin-Etsu Polymer Co., Ltd., can be employed.

The above phenylmethyl silicone oil has excellent thermal stability. Furthermore, in the case where the phenylmethyl silicone oil is used as the carrier liquid for a liquid developer, no oxides which will cause an unpleasant odor are generated therefrom when it is brought into contact with a heat-application roller which is heated for image fixing. Accordingly, it does not cause any environmental pollution problems. The liquid developer comprising a carrier liquid which contains at least phenylmethyl silicone oil is regarded as advantageous over conventional liquid developers from the viewpoint of hygiene.

In addition, the above-mentioned phenylmethyl silicone oil has no expandable properties and has no adverse influence on the copied images unlike dimethyl silicone oil although both belong to the silicone oil.

As the cyclic dimethyl polysiloxane for use in the present invention, a cyclic dimethyl polysiloxane represented by the following formula is preferably employed:

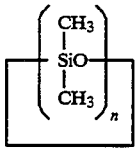

wherein n is an integer of 4 or 5.

When n is an integer of 4 or 5 in the above formula, an appropriate electric charge can be imparted to the toner, and at the same time, the boiling point of the carrier liquid is not so high that images formed on the transfer sheet readily get dry at an image fixing temperature ranging from 140° to 190° C.

The thermal stability of the above cyclic dimethyl polysiloxane is relatively high. Furthermore, in the case where the liquid developer comprising a carrier liquid which contains the cyclic dimethyl polysiloxane is used in the electrophotographic copying apparatus, no objectionable odor is generated therefrom when the carrier liquid is brought into contact with a heated heat-application roller. Accordingly, no environmental pollution problems are caused in the room where the copying apparatus is in operation even when a large number of copies are made continuously at high speed. The thus obtained liquid developer according to the present invention which comprises a carrier liquid containing at least cyclic dimethyl polysiloxane is also advantageous over conventional liquid developers from the viewpoint of hygiene.

Furthermore, although the above-mentioned cyclic dimethyl polysiloxane and acyclic dimethyl silicone oils are alike in chemical structure, the former does not show such serious expandable properties as are shown in the latter. Thus the cyclic dimethyl siloxane has no adverse effects on the copied images in practical use.

The aforementioned phenylmethyl silicone oil and cyclic dimethyl polysiloxane for use in the present invention have the advantage that evaporation loss is extremely small over the conventional aliphatic hydrocarbon liquids used as the carrier liquids.

The superiority of the phenylmethyl silicone oil and the cyclic dimethyl polysiloxane as the carrier liquids for the liquid developer to the conventional ones can be demonstrated in particular when a large number of copies are made at high speed.

The above phenylmethyl silicone oil or cyclic dimethyl polysiloxane can be used in combination with conventional aliphatic hydrocarbon liquids.

Examples of commercially available aliphatic hydrocarbon liquids are "Isopar L" (boiling point of 188 to 210° C.), "Isopar M" (boiling point of 205° to 252° C.), "Isopar G" (boiling point of 158° to 177° C.) and "Isopar H" (boiling point of 174° to 190° C.), made by Exxon Chemical Japan Ltd.; "IP Solvent 2028" (boiling point of 210° to 265° C.), Solvent 2835" (boiling point of 275° to 350° C.) and "IP Solvent 1620" (boiling point of 166° to 205° C.), made by Idemitsu Petrochemical Co., Ltd.; "Nisseki Isosol 400" (boiling point of 206° to 257° C.), made by Nippon Petrochemicals Co., Ltd.; and "Isododecane" (boiling point of 176° to 185° C.), made by BP Far East Ltd. In addition to the above, isooctane and ligroin, both having a boiling point ranging from 120° to 190° C. can be used.

In the present invention, conventional toner particles can be dispersed in a carrier liquid comprising phenylmethyl silicone oil or cyclic dimethyl polysiloxane.

As previously described, toner particles comprise a coloring agent and binder-resin.

Examples of inorganic pigments used as the coloring agent include commercially available "Printex G", "Printex V", "Printex U", "Special Black 15" and "Special Black 4" (made by Degussa Japan Co., Ltd.); "#44", "#30", "MR-11" and "MA-100" (made by Mitsubishi Carbon Co.); "Mogul L", "Black Pearl 1300", "Black Pearl 1100", "Black Pearl 900", "Regal 400" and "Regal 660" (made by Cabot Co., Ltd.); and "Neospectra II", "Robin 1035" and "Robin 1252" (made by Columbia Carbon Ltd.).

Examples of organic pigments used as the coloring agent include Phthalocyanine Blue, Phthalocyanine Green, Sky Blue, Rhodamine Lake, Malachite Green Lake, Methyl Violet Lake, Peacock Blue Lake, Naphthol Green B, Naphthol Green Y, Naphthol Yellow S, Naphthol Red, Lithol Fast Yellow 2G, Permanent Red 4R, Brilliant Fast Scarlet, Hansa Yellow, Benzidine Yellow, Lithol Red, Lake Red C, Lake Red D, Brilliant Carmine 6B, Permanent Red F5R, Pigment Scarlet 3B, Indigo, Thioindigo, Oil Pink and Bordeaux 10B.

For the binder resin in toner particles, copolymers and graft copolymers of vinyl monomer A having the following formula (I) and vinyl monomer B selected from the group consisting of a vinyl monomer having formula (II), vinylpyrridine, vinylpyrrolidone, ethylene glycol dimethacrylate, styrene, divinylbenzene and vinyltoluene can be employed.

[Vinyl monomer A] (I)

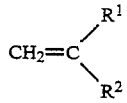

wherein $R^1$ represents hydrogen or a methyl group; and $R^2$ represents $—COOC_nH_{2n+1}$, in which n is an integer of 6 to 20.

[Vinyl monomer, one of vinyl monomer B] (II)

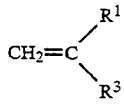

wherein $R^1$ represents hydrogen or a methyl group; and $R^3$ represents $—COOC_nH_{2n+1}$, in which n is an integer of 1 to 5,

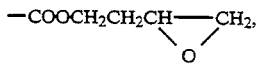

—COOH, —$COOCH_2CH_2OH$, —$COOCH_2CH_2N(CH_3)_2$, or —$COOCH_2CH_2N(C_2H_5)_2$.

In addition to the above, the following binder resins can be used in the present invention:

(a) Commercially available synthetic polyethylene, polypropyrene and modified products thereof:

—N-10", "N-11", "N-12", "N-14", "N-34", "N-45", "C-10", "C-13", "C-15", "C-16", "E-10", "E-11", "E-12", "E-14" and "E-15", made by Eastman Chemical Products, Inc.;

—"110P", "220P", "220MP", "320MP", "410MP", "210MP", "10MP", "405MP", "200P", "4202E" and "4053E", made by Mitsui Petrochemical Industries, Ltd.;

—"131P", "151P", "161P", "171P", "E300" and "E250P", made by Sanyo Chemical Industries, Ltd.;

—"H1", "H2", "A1", "A2", "A3" and "A4", made by Sazol Co., Ltd.;

—"OA Wax" and "A Wax", made by BASF Japan Ltd.;

—"Bareco 500", "Bareco 2000", "E-730", "E-2018", "E-2020", "E-1040", "Petronaba C", "Petronaba C-36", "Petronaba C-400" and "Petronaba C-7500", made by Petrolite Co., Ltd.;

—"PE580", "PE130", "PED121", "PED136", "PED153", "PED521", "PED522" and "PED534", made by Hoechst Japan Limited.;

—"DYNI", "DYNF", "DYNH", "DYNJ" and "DYNK", made by Union Carbide Japan K.K.;

—"Orlizon 805", "Orlizon 705" and "Orlizon 50", made by Monsanto Co.;

—"Alathon 3", "Alathon 10", "Alathon 12", "Alathon 14", "Alathon 16", "Alathon 20", "Alathon 22" and "Alathon 23", made by Du pont de Nemours, E.I. & Co.;

—"AC Polyethylene 6", "AC Polyethylene 6A" and "AC Polyethylene 15", made by Allied Chemical Corp.; and —"Evaflex 150", "Evaflex 210", "Evaflex 220", "Evaflex 250", "Evaflex 260", "Evaflex 310", "Evaflex 360", "Evaflex 410", "Evaflex 420", "Evaflex 450", "Evaflex 460", "Evaflex 550" and "Evaflex 560", made by Du Pont-Mitsui Polychemicals Co., Ltd.

(b) Natural waxes such as carnauba wax, montan wax, candelilla wax, sugar cane wax, ouricury wax, beeswax, Japan wax and rice bran wax.

(c) Natural resins such as etser gum and hardened rosin.

(d) Natural-resin-modified cured resins such as natural resin modified maleic acid resin, natural resin modified phenolic resin, natural resin modified polyester resin, natural resin modified pentaerythritol resin and epoxy resin.

The liquid developer according to the present invention can be prepared by dispersing the above-mentioned coloring agent, binder resin and carrier liquid containing at least a phenylmethyl silicone oil or a cyclic dimethyl polysiloxane in a dispersion mixer such as a ball mill, Kitty mill, disk mill, pin mill and oscillating mill, and kneading the mixture to prepare a toner particle having a diameter of 0.1 to 4.0 μm.

In the preparation of the liquid developer according to the present invention, the coloring agent may be preferably kneaded together with the binder resin such as the previously-mentioned synthetic polyethylenes, natural resins, and natural-resin-modified cured resins prior to the dispersion in the carrier liquid.

Other features of this invention will become apparent in the course of the following description of exemplary embodiments, which are given for illustration of the invention and are not intended to be limiting thereof.

EXAMPLE 1

The following components were mixed and kneaded in a three-roll mill, so that a mixture of a coloring agent and a binder resin was prepared:

| | Parts by Weight |
|---|---|
| Carbon black (Trademark "Printex U" made by Degussa Japan Co., Ltd.) | 300 |
| Natural resin modified maleic acid (Trademark "Tescon MRP" made by Tokushima Seiyu Co., Ltd.) | 200 |
| Polyethylene (Trademark "171P" made by Sanyo Chemical Industries, Ltd. | 600 |

The following components were mixed and kneaded in a pin mill, so that a concentrated toner was prepared:

| | Parts by Weight |
|---|---|
| The above-prepared mixture of the coloring agent and binder resin | 1000 |
| Isopar H dispersion of methyl methacrylate/stearyl methacrylate/hydroxyethyl methacrylate/methacrylic acid copolymer (10/80/10/10) (solid content of 33%) | 600 |
| "Isopar H" (Trademark), made by Exxon Chemical Japan Ltd. | 2400 |

100 parts by weight of the thus prepared concentrated toner was dispersed in 1000 parts by weight of a commercially available phenylmethyl silicone oil, "KF-56" (Trademark), made by Shin-EtsuPolymer Co., Ltd., whereby a liquid developer No. 1 according to the present invention was obtained.

The above-obtained liquid developer No. 1 according to the present invention was subjected to a copying test, using a commercially available wet-type copying apparatus, "CT-5085" (Trademark), made by Ricoh Company, Ltd.

In the above-mentioned wet-type copying apparatus, an image fixing unit as shown in FIG. 2 was mounted, with a line velocity of a transfer sheet set at 228 mm/sec, an electric power of a heater 202 which is built in a heat-application roller 201 at application 700 W, and a surface temperature of the heat-application roller 201° at 210°±10° C.

Using the above wet-type copying apparatus, copies were continuously made for 15 minutes by allowing a transfer sheet of A-4 size having an image area ratio of 7% to pass sidewise at a copying rate of 35 copies per minute. This copying test was carried out in a room of 30 $m^3$, lined with stainless steel and not ventilated.

In the copying test, the following items were evaluated:

(1) Separation of layers in the liquid developer (observed after the developer was allowed to stand for 24 hours.)
- o: no separation of layers
- Δ: slight separation of layers (cloudy supernatant liquid)
- x: separation of layers (clear supernatant liquid)

(2) Aggregation of toner particles in the liquid developer (observed after the developer was allowed to stand for 24 hours.)
- o: no aggregation (a toner particle having an average particle diameter of 0.5 to 0.8 μm)
- Δ: slight aggregation (a toner particle having an average particle diameter of 0.7 to 2 μm)
- x: marked aggregation (a toner particle having an average particle diameter of 2 μm or more)

(3) Sharpness of obtained images (observed at the first copy produced by the copying operation after the liquid developer was allowed to stand for 24 hours.)
- 5: clear images without character deformation
- 4: character images with slight deformation
- 3: character images with deformation to such a degree that it has no effect on the practical use.
- 2: unclear images with character deformation
- 1: illegible
- —: no image formation (4) Unpleasant odor after continuous copying operation over a period of 15 minutes
- 5: no odor
- 4: faint odor
- 3: distinct odor 2: strong odor
1: extremely strong odor (5) Image density of obtained images (observed at the first copy produced by the copying operation after the liquid developer was allowed to stand for 24 hours.)
—measured by Macbeth densitometer.

EXAMPLES 2 TO 4 AND COMPARATIVE EXAMPLES 1 TO 11

The procedure for preparation of the liquid developer No. 1 according to the present invention employed in Example 1 was repeated except that a commercially available phenylmethyl silicone oil (Trademark "KF-56" made by Shin-Etsu Polymer Co., Ltd., used as the carrier liquid in Example 1, was replaced by the respective carrier liquids as listed in Table 1, whereby liquid developers No. 2 to No. 4 according to the present invention and comparative liquid developers No. 1 to No. 11 were obtained.

Using the thus obtained liquid developers, the same evaluation was carried out in the same manner as employed in Example 1.

The results are given in Table 1.

TABLE 1

| | Carrier Liquid | Separation of layers | Aggregation of Toner Particles | Image Density | Sharpness | Unpleasant Odor |
|---|---|---|---|---|---|---|
| Example No. | | | | | | |
| 1 | Phenylmethyl silicone oil "KF-56" | O | O | 1.43 | 4 | 5 |
| 2 | Phenylmethyl silicone oil "KF-56"/"Isopar H" (75/25 vol %) | O | O | 1.48 | 5 | 5 |
| 3 | Phenylmethyl silicone oil "KF-56"/"Isopar H" (50/50 vol %) | O | O | 1.50 | 5 | 4.5 |
| 4 | Phenylmethyl silicone oil "KF-56"/"Isopar H" (25/75 vol %) | O | O | 1.50 | 5 | 4 |
| Comparative Example | | | | | | |
| 1 | Dimethyl silicone (0.65 cs) | X | X | 0.88 | 2 | 5 |
| 2 | Dimethyl silicone (1 cs) | X | X | 0.33 | 2 | 5 |
| 3 | Dimethyl silicone (6 cs) | X | X | — | — | — |
| 4 | Dimethyl silicone (10 cs) | X | X | — | — | — |
| 5 | Aliphatic hydrocarbon liquid "Isopar C" | O | O | 1.45 | 5 | 2.5 |
| 6 | Aliphatic hydrocarbon liquid "Isopar E" | O | O | 1.44 | 5 | 2.5 |
| 7 | Aliphatic hydrocarbon liquid "Isopar G" | O | O | 1.48 | 5 | 2.5 |
| 8 | Aliphatic hydrocarbon liquid "Isopar H" | O | O | 1.51 | 5 | 3 |
| 9 | Aliphatic hydrocarbon liquid "Isopar K" | O | O | 1.50 | 5 | 3 |
| 10 | Aliphatic hydrocarbon liquid "Isopar L" | O | O | 1.53 | 4 | 3.5 |
| 11 | Aliphatic hydrocarbon liquid "Isopar M" | O | O | 1.55 | 3 | 4 |

As can be seen from the results in Table 1, the liquid developers according to the present invention do not generate any unpleasant odor due to the evaporation of carrier liquid at the image fixing step and the obtained images are remarkably excellent. This is because the carrier liquid of the developer comprises at least a phenylmethyl silicone oil.

EXAMPLES 5 TO 12

The procedure for preparation of the liquid developer No. 1 according to the present invention employed in Example 1 was repeated except that a commercially available phenylmethyl silicone oil (Trademark "KF-56" made by Shin-Etsu Polymer Co., Ltd., used as the carrier liquid in Example 1, was replaced by the respective carrier liquids at least comprising a cyclic dimethyl polysiloxane, as listed in Table 2, whereby liquid developers No. 5 to No. 12 according to the present invention were obtained.

Each of the above-obtained liquid developers No. 5 to No. 12 according to the present invention was subjected to a copying test, using the same commercially available wet-type copying apparatus (Trademark "CT-5085" (Trademark) made by Ricoh Company, Ltd.) under the same conditions as in Example 1.

In the copying operation, the following items were evaluated:

(1) Sharpness of obtained images
5: clear images without character deformation
4: character images with slight deformation
3: character images with deformation to such a degree that it has no effect on the practical use.
2: unclear images with character deformation
1: illegible
—: no image formation (2) Unpleasant odor after continuous copying operation over a period of 15 minutes
5: no odor
4: faint odor
3: distinct odor
2: strong odor
1: extremely strong odor (3) Image density of obtained images
—measured by Macbeth densitometer.

(4) Bubbling
—The inclination to bubbling after 30 seconds was measured in accordance with JIS K 3362.3.15.
: 0 mλ
Ⓐ: 10 mλ or less
Δ: 30 mλ or less
x: 50 mλ or less
xx: 100 mλ or less The results are given in Table 2.

TABLE 2

| Example No. | Carrier Liquid | Image Density | Sharpness | Bubbling | Unpleasant Odor |
|---|---|---|---|---|---|
| 5 | Cyclic dimethyl polysiloxane (n = 4) | 1.43 | 3.5 | Ⓐ | 5 |
| 6 | Cyclic dimethyl polysiloxane (n = 5) | 1.39 | 3.5 | Ⓐ | 5 |
| 7 | Cyclic dimethyl polysiloxane (n = 4)/ Isopar H (75/25 vol %) | 1.47 | 4 | ○ | 5 |

TABLE 2-continued

| Example No. | Carrier Liquid | Image Density | Sharpness | Bubbling | Unpleasant Odor |
|---|---|---|---|---|---|
| 8 | Cyclic dimethyl polysiloxane (n = 4)/ Isopar H (50/50 vol %) | 1.51 | 5 | ○ | 5 |
| 9 | Cyclic dimethyl polysiloxane (n = 4)/ Isopar H (25/75 vol %) | 1.53 | 4 | ○ | 5 |
| 10 | Cyclic dimethyl polysiloxane (n = 5)/ Isopar H (75/25 vol %) | 1.41 | 4 | ○ | 5 |
| 11 | Cyclic dimethyl polysiloxane (n = 5)/ Isopar H (50/50 vol %) | 1.44 | 5 | ○ | 5 |
| 12 | Cyclic dimethyl polysiloxane (n = 5)/ Isopar H (25/75 vol %) | 1.49 | 5 | ○ | 5 |

As can be seen from the results in Table 2, the liquid developers according to the present invention do not generate any unpleasant odor due to the evaporation of carrier liquid at the image fixing step. This is because the carrier liquid of the developer comprises at least a cyclic dimethyl siloxane.

What is claimed is:

1. A liquid developer for developing latent electrostatic images, which comprises (i) a carrier liquid comprising 5 vol % or more of at least one component selected from the group consisting of a phenylmethyl silicone oil and a cyclic dimethyl polysiloxane, and (ii) toner particles dispersed in said carrier liquid.

2. The liquid developer for developing latent electrostatic images as claimed in claim 1, wherein said carrier liquid comprises a phenylmethyl silicone oil.

3. The liquid developer for developing latent electrostatic images as claimed in claim 1, wherein said carrier liquid comprises a cyclic dimethyl polysiloxane.

4. The liquid developer for developing latent electrostatic images as claimed in claim 3, wherein said cyclic dimethyl polysiloxane is a compound with formula (I):

(I)

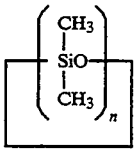

wherein n is an integer of 4 or 5.

5. The liquid developer for developing latent electrostatic images as claimed in claim 1, wherein said carrier liquid further comprises an aliphatic hydrocarbon liquid.

6. The liquid developer for developing latent electrostatic images as claimed in claim 1, wherein said cyclic dimethyl polysiloxane is a compound with formula (I):

(I)

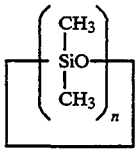

wherein n is an integer of 4 or 5.

7. The liquid developer for developing latent electrostatic images as claimed in claim 1, wherein said component is contained in said carrier liquid in an amount of 50 vol. % or more of the total amount of the carrier liquid.

8. A wet-type electrophotographic image formation method comprising the steps of:

developing latent electrostatic images formed on an electrophotographic photoconductor with a liquid developer comprising (i) a carrier liquid comprising 5 vol % or more of at least one component selected from the group consisting of a phenylmethyl silicone oil and a cyclic dimethyl polysiloxane, and (ii) toner particles dispersed in said carrier liquid, transferring the toner images to a transfer sheet, and thermally fixing the transferred toner images onto the transfer sheet.

* * * * *